US010400581B2

(12) United States Patent
Dykstra et al.

(10) Patent No.: US 10,400,581 B2
(45) Date of Patent: Sep. 3, 2019

(54) CONTINUOUS LOCATING WHILE DRILLING

(71) Applicant: HALLIBURTON ENERGY SERVICES, INC., Houston, TX (US)

(72) Inventors: Jason D. Dykstra, Spring, TX (US); Yuzhen Xue, Humble, TX (US); Fanping Bu, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 161 days.

(21) Appl. No.: 15/532,054

(22) PCT Filed: Dec. 31, 2014

(86) PCT No.: PCT/US2014/073025
§ 371 (c)(1),
(2) Date: May 31, 2017

(87) PCT Pub. No.: WO2016/108901
PCT Pub. Date: Jul. 7, 2016

(65) Prior Publication Data

US 2017/0335676 A1 Nov. 23, 2017

(51) Int. Cl.
*E21B 47/09* (2012.01)
*E21B 47/00* (2012.01)
(Continued)

(52) U.S. Cl.
CPC ..... *E21B 47/09* (2013.01); *E21B 7/04* (2013.01); *E21B 7/10* (2013.01); *E21B 47/0006* (2013.01);
(Continued)

(58) Field of Classification Search
CPC ..... E21B 47/09; E21B 47/0006; E21B 7/04; E21B 7/10; E21B 47/024; E21B 49/00; E21B 47/18; E21B 47/02
See application file for complete search history.

(56) References Cited

U.S. PATENT DOCUMENTS 6,453,239 B1 9/2002 Shirasaka et al.
2005/0126022 A1 6/2005 Hansberry et al.
(Continued)

FOREIGN PATENT DOCUMENTS

CA 2954264 A1 2/2016
EP 2775093 9/2014
(Continued)

OTHER PUBLICATIONS

PCT International Search Report and Written Opinion, dated Sep. 25, 2015, Appl No. PCT/US14/73025, "Continuous Locating While Drilling," Filed Dec. 31, 2014, 15 pgs.
(Continued)

*Primary Examiner* — Wei Wang
(74) *Attorney, Agent, or Firm* — Jason Sedano; Parker Justiss, P.C.

(57) ABSTRACT

Locating while drilling systems and methods are disclosed. Some method embodiments include drilling a borehole with a bottom-hole assembly (BHA attached to a drill bit, pausing the drilling to determine a survey position of the bit, obtaining measurements with BHA sensors while drilling, processing the BHA sensor measurements with a model while drilling to track a current position of the bit relative to the survey position, the model accounting for deformation of the BHA, and steering the BHA based on the current position of the bit.

17 Claims, 3 Drawing Sheets

(51) Int. Cl.

| | |
|---|---|
| ***E21B 7/04*** | (2006.01) |
| ***E21B 7/10*** | (2006.01) |
| ***E21B 47/024*** | (2006.01) |
| ***E21B 49/00*** | (2006.01) |
| ***E21B 47/18*** | (2012.01) |

(52) U.S. Cl.
CPC ..... *E21B 47/024* (2013.01); *E21B 47/18* (2013.01); *E21B 49/00* (2013.01)

(56) References Cited

U.S. PATENT DOCUMENTS

| | | | | |
|---|---|---|---|---|
| 2005/0150689 | A1* | 7/2005 | Jogi ..... | E21B 7/06 175/45 |
| 2005/0241824 | A1 | 11/2005 | Burris, II et al. | |
| 2005/0279532 | A1 | 12/2005 | Ballantyne et al. | |
| 2012/0125077 | A1 | 5/2012 | Rodney et al. | |
| 2013/0076526 | A1 | 3/2013 | Schuberth et al. | |

FOREIGN PATENT DOCUMENTS

| | | | |
|---|---|---|---|
| WO | 9715749 | A2 | 5/1997 |
| WO | 03089751 | A2 | 10/2003 |
| WO | 2013192524 | A2 | 12/2013 |
| WO | 2014046668 | A1 | 3/2014 |
| WO | 2016024945 | A1 | 2/2016 |
| WO | 2016043724 | A1 | 3/2016 |

OTHER PUBLICATIONS

Elgizway, Mahmoud, et al., "Wellbore Surveying While Drilling Based on Kalman Filtering," Am. J. Engg. & Applied Sci.,2010, 240-259, vol. 3, Issue 2.

Panchal, N., et al., "Robust Linear Feedback Control of Attitude for Directional Drilling Tools," 13th Symposium on Automation in Mining, Mineral and Metal Processing Cape Town, South Africa, Aug. 2-4, 2010.

* cited by examiner

CONTINUOUS LOCATING WHILE DRILLING

BACKGROUND

Directional drilling is the process of directing a borehole along a defined trajectory. Deviation control during drilling is the process of keeping the borehole trajectory contained within specified limits, e.g., limits on the inclination angle or distance from the defined trajectory. Both have become important to developers of hydrocarbon resources.

Every bottom-hole assembly (BHA) drilling a deviated borehole rests on the low side of the borehole, thereby experiencing a reactive force that causes the BHA to tend upward (increase borehole inclination due to a fulcrum effect), tend downward (decrease borehole inclination due to a pendular effect), or tend neutral (maintain inclination). Even for the same BHA, the directional tendencies may change due to formation effects, bit wear, inclination angle, and parameters that affect stiffness such as rotational speed, vibration, weight-on-bit (WOB), and wash-outs. Parameters that can be employed to intentionally affect directional tendency include the number, placement, and gauge of stabilizers, the bend angles associated with the steering mechanism, the distance of the bends from the bit, rotational speed, WOB, and rate-of-penetration (ROP).

Various drillstring steering mechanisms exist to provide directional drilling: whipstocks, mud motors with bent-housings, jetting bits, adjustable gauge stabilizers, and rotary steering systems (RSS). These techniques each employ side force, bit tilt angle, or some combination thereof, to steer the drillstring's forward and rotary motion. However, the resulting borehole's actual curvature is not determined by these parameters alone, and it is often difficult to predict the location of the bit during drilling. Such difficulty necessitates slow drilling, frequent survey measurements, and in many cases, frequent trips of the drillstring to the surface to adjust the directional tendency of the steering assembly. Such necessity produces undesirably undulatory and tortuous wellbores and the many problems associated therewith.

BRIEF DESCRIPTION OF THE DRAWINGS

Accordingly, there are disclosed herein certain locating while drilling systems and methods that provide continuous tracking while accounting for deformations of the bottom-hole assembly. In the following detailed description of the various disclosed embodiments, reference will be made to the accompanying drawings in which.

Figure 1:
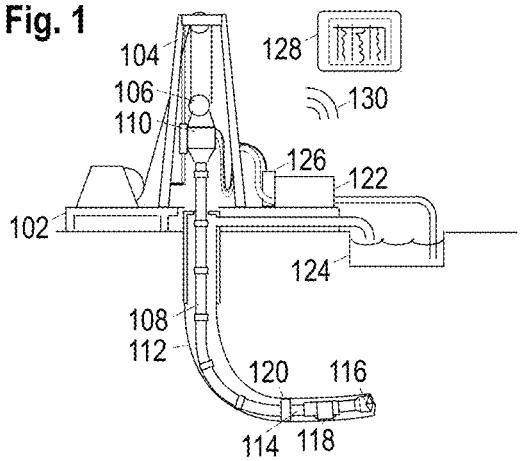
FIG. 1 is a schematic view of an illustrative locating while drilling environment.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

NOTATION AND NOMENCLATURE

Certain terms are used throughout the following description and claims to refer to particular system components and configurations. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ". Also, the term "couple" or "couples" is intended to mean either an indirect or a direct electrical connection. Thus, if a first device couples to a second device, that connection may be through a direct electrical connection, or through an indirect electrical connection via other devices and connections. In addition, the term "attached" is intended to mean either an indirect or a direct physical connection. Thus, if a first device attaches to a second device, that connection may be through a direct physical connection, or through an indirect physical connection via other devices and connections.

DETAILED DESCRIPTION

The issues identified in the background are at least partly addressed by systems and methods for locating while drilling. To provide context, an illustrative locating while drilling environment is shown in FIG. 1. A drilling platform 102 supports a derrick 104 having a traveling block 106 for raising and lowering a drillstring 108. A top drive 110 supports and rotates the drillstring 108 as it is lowered into a borehole 112. The rotating drillstring 108 and/or a downhole motor assembly 114 rotates a drill bit 116. As the drill bit 116 rotates, it extends the borehole 112 in a directed manner through various subsurface formations. The downhole assembly 114 includes a RSS 118 which, together with one or more stabilizers 120, enables the drilling crew to steer the borehole along a desired path. A pump 122 circulates drilling fluid through a feed pipe to the top drive 110, downhole through the interior of drillstring 108, through orifices in drill bit 116, back to the surface via the annulus around drillstring 108, and into a retention pit 124. The drilling fluid transports cuttings from the borehole into the retention pit 124 and aids in maintaining the borehole integrity.

The drill bit 116 and downhole motor assembly 114 form just one portion of a bottom-hole assembly (BHA) that includes one or more drill collars (i.e., thick-walled steel pipe) to provide weight and rigidity to aid the drilling process. Some of these drill collars include built-in logging instruments to gather measurements of various drilling parameters such as position, orientation, WOB, torque, vibration, borehole diameter, downhole temperature and pressure, etc. The tool orientation may be specified in terms of a tool face angle (rotational orientation), an inclination angle (the slope), and compass direction, each of which can be derived from measurements by magnetometers, inclinometers, and/or accelerometers, though other sensor types such as gyroscopes may alternatively be used. In one specific embodiment, the tool includes a 3-axis fluxgate magnetometer and a 3-axis accelerometer. The combination of those two sensor systems enables the measurement of the tool face angle, inclination angle, and compass direction.

One or more logging while drilling (LWD) tools may also be integrated into the BHA for measuring parameters of the formations being drilled through. As the drill bit 116 extends the borehole 112 through the subsurface formations, the LWD tools rotate and collect measurements of such parameters as resistivity, density, porosity, acoustic wave speed, radioactivity, neutron or gamma ray attenuation, magnetic resonance decay rates, and indeed any physical parameter for which a measurement tool exists. A downhole controller associates the measurements with time and tool position and orientation to map the time and space dependence of the measurements. The measurements can be stored in internal memory and/or communicated to the surface.

A telemetry sub may be included in the bottom-hole assembly to maintain a communications link with the surface. Mud pulse telemetry is one common telemetry technique for transferring tool measurements to a surface interface 126 and to receive commands from the surface interface, but other telemetry techniques can also be used. Typical telemetry data rates may vary from less than one bit per minute to several bits per second, usually far below the necessary bandwidth to communicate all of the raw measurement data to the surface.

The surface interface 126 is further coupled to various sensors on and around the drilling platform to obtain measurements of drilling parameters from the surface equipment, parameters such as hook load, rate of penetration, torque, and rotations-per-minute (RPM) of the drillstring.

A processing unit, shown in FIG. 1 in the form of a tablet computer 128, communicates with surface interface 126 via a wired or wireless network communications link 130, and provides a graphical user interface (GUI) or other form of interactive interface that enables a user to provide commands and to receive (and optionally interact with) a visual representation of the acquired measurements. The measurements may be in log form, e.g., a graph of the borehole trajectory and/or measured parameters as a function of time and/or position along the borehole. The processing unit can take alternative forms, including a desktop computer, a laptop computer, an embedded processor, a cloud computer, a central processing center accessible via the internet, and combinations of the foregoing.

In addition to the uphole and downhole drilling parameters and measured formation parameters, the surface interface 126 or processing unit 128 may be further programmed with additional parameters regarding the drilling process, which may be entered manually or retrieved from a configuration file. Such additional parameters may include, for example, the specifications for the drillstring and BHA, including drilling tubular and collar materials, stabilizer diameters and positions, and limits on side forces and dogleg severity. The additional information may further include a desired borehole trajectory and limits on deviation from that trajectory. Experiences and logs from standoff wells may also be included as part of the additional information.

Figure 2:
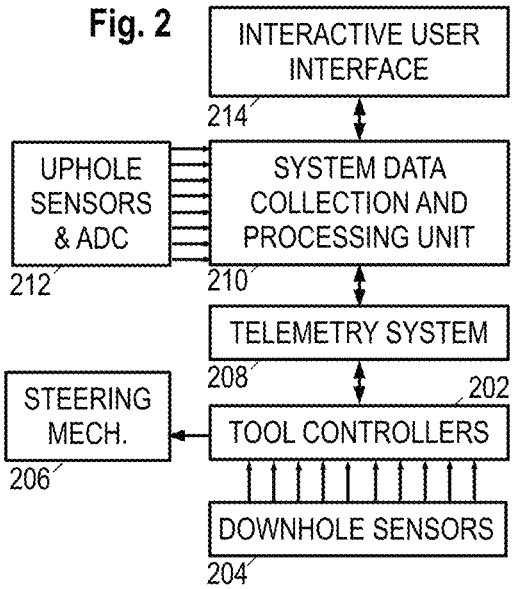
FIG. 2 is a block diagram of an illustrative locating while drilling system.

FIG. 2 is a function-block diagram of an illustrative locating while drilling system. One or more downhole tool controllers 202 collect measurements from a set of downhole sensors 204, preferably but not necessarily including both drilling parameter sensors and formation parameter sensors, to be digitized and stored, with optional downhole processing to compress the data, improve the signal to noise ratio, and/or to derive parameters of interest from the measurements.

A telemetry system 208 conveys at least some of the measurements or derived parameters to a processing system 210 at the surface, the uphole system 210 collecting, recording, and processing the telemetry information from downhole as well as from a set of sensors 212 on and around the rig. Processing system 210 generates a display on interactive interface 214 of the relevant information, e.g., measurement logs, borehole trajectory, or extracted values such as directional tendency and recommended drilling parameters to achieve the desired steering. The processing system 210 may further accept user inputs and commands and operate in response to such inputs to, e.g., transmit commands and configuration information via telemetry system 208 to the downhole processor 206. Such commands may alter the settings of the steering mechanism.

Figure 3:
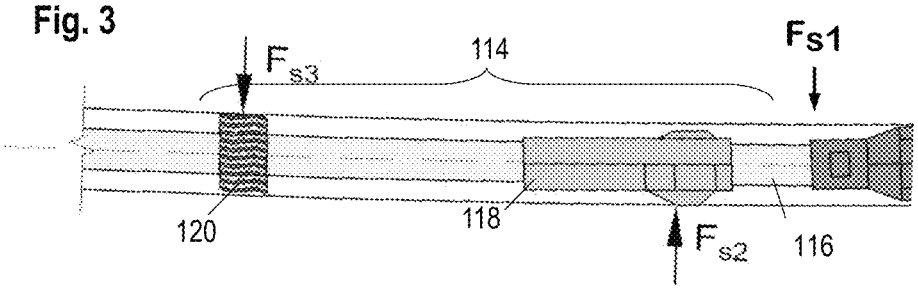
FIG. 3 is a schematic side view of an illustrative push-the-bit steering mechanism.

FIG. 3 shows an illustrative RSS and downhole assembly 114 of the push-the-bit type, which employs a non-rotating sleeve with a push pad 118 that can press against a selected side of the borehole, acting as an eccentering mechanism that introduces an adjustable eccentricity, thereby experiencing a side force FS2. The bit 116 and the stabilizer 120 experience reactive side forces FS1 and FS3. The balance of forces on the BHA introduce some degree of side-cutting by the bit and some degree of bit tilt, which combine to yield a total walk angle for the BHA. The total walk angle is controlled with the push pad 118 to enable steering of the borehole along a desired trajectory.

Figure 4:
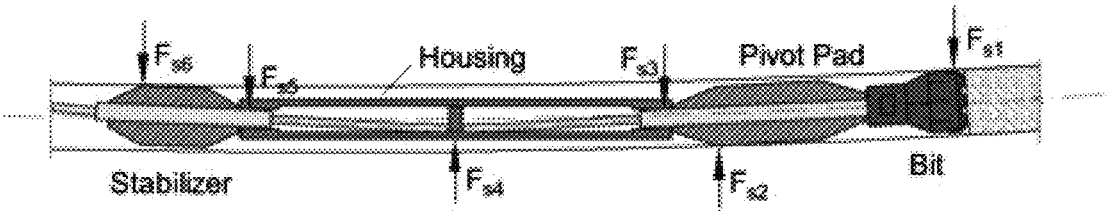
FIG. 4 is a schematic side view of an illustrative point-the-bit steering mechanism.

FIG. 4 shows an illustrative RSS and downhole assembly of the point-the-bit type, which employs a non-rotating housing that introduces an adjustable bend in the drillstring, resulting in a controllable bit tilt angle. An eccentricity ring within the housing acts as an eccentering mechanism to provide the adjustable bend. Attached to the housing are a stabilizer and a non-rotating pivot pad. In addition to an internal side force FS4 exerted by the housing on the shaft of the drillstring, the bit, the pivot pad, the housing ends, and the stabilizer each experience respective side forces FS1, FS2, FS3, FS5, and FS6. The balance of these forces further affect the bit tilt angle and introduce some degree of side cutting, which together yield a total walk angle for the BHA. The total walk angle is controlled by the eccentricity ring to enable steering of the borehole along a desired trajectory.

Figure 5:
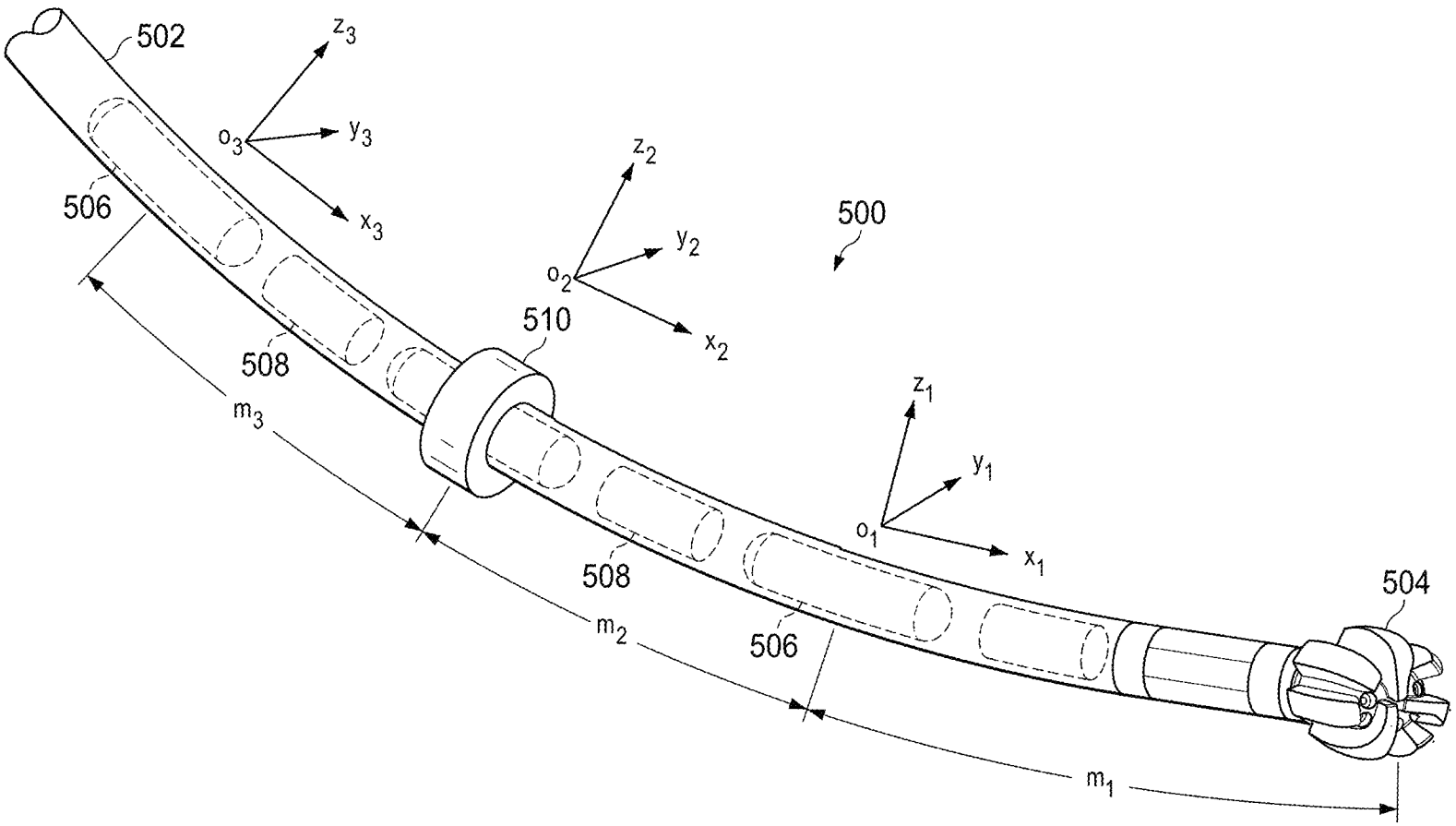
FIG. 5 is a perspective view of an illustrative bottom-hole assembly (BHA) for use in a locating while drilling environment.

FIG. 5 shows the construction of an illustrative BHA model 502 for use in a locating while drilling system 500. The BHA 502, which includes the bit 504, may be divided into a number of sections for purposes of modeling BHA deformation in a fashion that facilitates locating the bit 504 while drilling. As illustrated, the BHA 502 is divided into three rigid sections, $m_1$, $m_2$, and $m_3$, of differing lengths but the BHA 502 may be divided into a different number of sections of the same or different lengths in different embodiments. An abrupt change in the spring constant of the BHA 502 indicates a suitable position for a section break, though other division schemes are possible. Each section preferably includes a strain measurement tool 506, sometimes called a DrillDOC®, and optionally includes a drilling string dynamics sensing tools (DDSR) 508 positioned between two strain measurement tools 506. As the BHA deformation will be at least partly modeled as localized bending between sections, one of the section breaks is preferably positioned at the geo-pilot 510 or other steering mechanism.

The position of the bit 504 while drilling may be calculated using a dead-reckoning algorithm that accounts for the motion and deformation of the BHA 502. Dead-reckoning is the process of calculating the bit's current position by noting the bit's previously determined and correct position, or fix, and advancing that position based upon one or more parameters collected during drilling. During pauses in drilling, which are usually thirty feet apart due to new sections of pipe being added to the top of the drillstring, surveys may be performed to obtain an updated fix. In some cases, if double or triple sections of pipe are used, the surveys may be performed sixty or ninety feet apart respectively. Such surveys, which provide the fix, cannot be performed during drilling due to motion and the vibrations caused by the powerful forces necessary to rotate the bit 504. However, sensor measurements for the dead-reckoning algorithm can be collected while drilling, i.e., while the drill bit is turning and engaged with the formation. Such sensor measurements may be used to continuously locate the bit 504 while drilling.

The strain measurement tools 506 include strain measurement sensors to measure the torsion, tension, bending, and compression strains of the sections of the BHA 502 in which they are positioned. The strain measurement tool 506 closest to the bit may indirectly measure the WOB and torque-on-bit (TOB). The DDSRs 508 measure acceleration and gravitational field along the BHA 502. The BHA 502 may also include gyroscopic sensors to measure angular rotational rate, rotary sensors to measure point direction angle and bending angle in the BHA 502, magnetometer sensors to measure magnetic field, and pressure sensors to measure depth. Additional sensors in geo-pilot 510 may measure the RPM of the bit 504.

Each section, $m_1$, $m_2$, $m_3$, of the BHA 502 is modeled as a rigid body having six degrees of freedom with respect to its neighbor sections. The coordinates $x_i y_i z_i$ represent the ith section of the BHA with an origin, $o_i$, located at the beginning (uphole) of the section and axes, $x_i y_i z_i$, aligned with the section. For example, the section $m_3$ begins at the origin, $o_3$, of the local coordinate system of $x_3$, $y_3$, $z_3$. With deformation measurements measured by the strain measurement tool 506, the coordinate transformation between the (i+1)th and ith local coordinates can be determined. In this way, the position of the bit 504 may be calculated from the coordinate transformation of the $m_1$ section of the BHA 502, $m_1$ being the section of the BHA 502 closes to the bit 504. For example, a dynamic modeling of the BHA 502 may be written as:

$$\dot{X}=f_X(X,u_X,w_X)$$

$$\dot{Y}=f_Y(Y,u_Y,w_Y)$$

$$\dot{Z}=f_Z(Z,u_Z,w_Z) \qquad \text{Eqs. (1, 2, 3)}$$

where $\dot{X} \triangleq [(\dot{x}_1, x_2-x_1, \dot{x}_2, x_3-x_2, \dot{x}_3, \ldots, \dot{x}_N]$, N represents the total number of sections in the BHA 502, w represents noise, and u represents a combination of the input force from the drillstring to the BHA 502, the bending force from the geo-pilot 510, and the rock reactive force at the bit. Y and Z are defined similarly to X. The 3-axis accelerations of each section are measured by the corresponding DDSRs, and the 3-axis strain between two adjacent sections ($x_i-x_{i+1}$, $y_i-y_{i+1}$, $z_i-z_{i+1}$) are measured by the corresponding strain measurement sensors. This dynamic modeling describes the relationship between the position of the sections and the strain measurements. A linear approximation may be written as:

$$\dot{X}=A_X X+B_X u_X+w_X$$

$$\dot{Y}=A_Y Y+B_Y u_Y+w_Y$$

$$\dot{Z}=A_Z X+B_Z u_Z+w_Z \qquad \text{Eqs. (3, 4, 5)}$$

where the additional terms A and B are matrices with elements including the mass, spring constants, and damping coefficients of each section of the BHA 502.

A kinematic equation modeling of the BHA 502 may be written as:

$$\dot{x}=f(x,u)$$

$$y=h(x,u) \qquad \text{Eqs. (6, 7)}$$

where $x=[E_b, N_b, H_b, \dot{E}_b, \dot{N}_b, \dot{H}_b, \Theta_b, \Phi_b, \Psi_b, w]$ is an internal state vector, $E_b$, $N_b$ and $H_b$ represent the bit position, $\dot{E}_b$, $\dot{N}_b$, and $\dot{H}_b$ represent the bit velocity, $\Theta_b$, $\Phi_b$, and $\Psi_b$ represent the bit attitudes (Euler angles), and w represents bias vector of gyro and accelerometer sensors and the bit walk rate derived from the accelerometers and gyros. The measurement output y may be provided by the survey, and the system input u represents the measurements from gyros and accelerometers.

The position of the bit may be calculated continuously while drilling as the model is updated with the sensor measurements. Iterative comparison between the calculated bit position and the intermittent survey measurements may be performed as needed, and a new survey may be triggered if an error, or deviation from the projected bit position, is above a threshold. The new survey may be triggered immediately or during the next scheduled pause in drilling. The dead-reckoning algorithm may be implemented in a dead-reckoning model that models the BHA, the bit, the borehole, and the formation as desired. Also, as described above, the dead-reckoning model may be trained to account for noise and other uncertainties in the drilling process. In a training stage, a number of surveys are performed during drilling pauses and sensor measurements are collected during drilling. This data is collectively used as training data. Specifically, the dead-reckoning algorithm is performed on the training data, and the difference between calculated bit positions and known bit positions, or error, is fed back into the model for tuning purposes. In this way, a model of noise and other uncertainty may be modeled.

Figure 6:
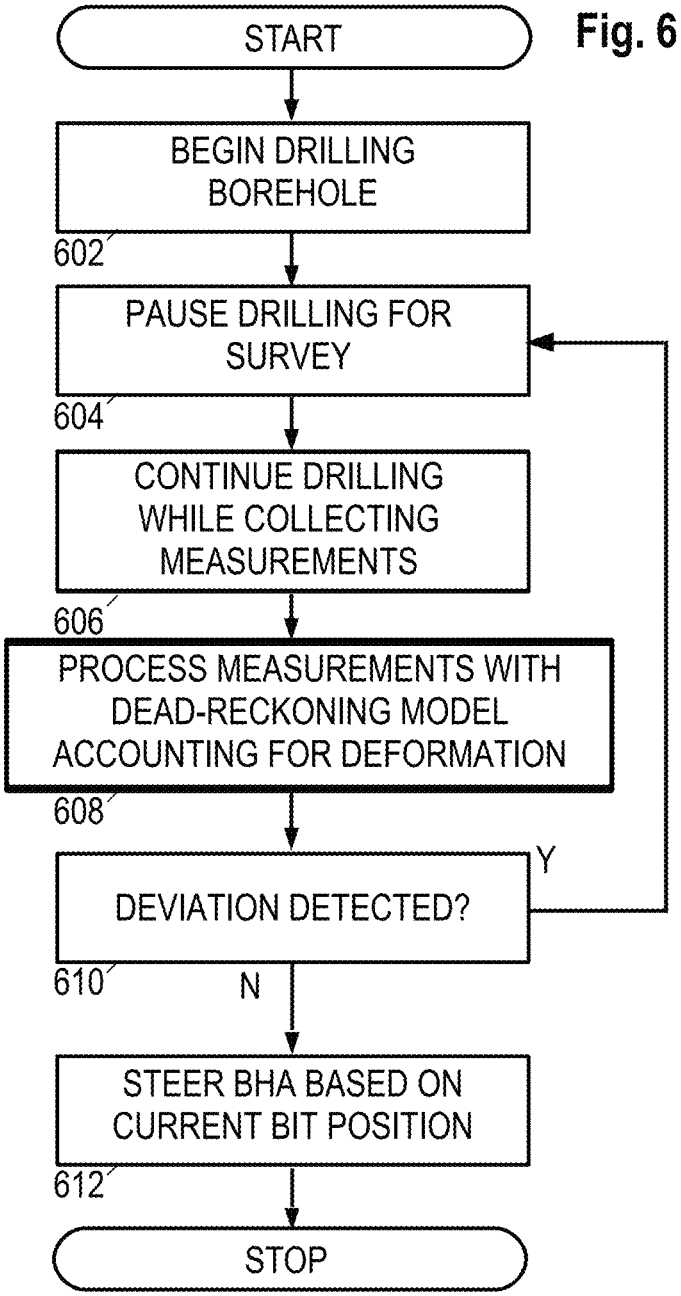
FIG. 6 is a flow diagram of an illustrative method of locating while drilling.

FIG. 6 is a flow diagram illustrating a method of locating while drilling. At 602, a borehole is drilled with a bottom-hole assembly (BHA) terminated by a drill bit. The BHA sensors may include strain sensors and drilling string dynamics sensors (DDSRs). The strain sensors measure the torsion, tension, bending, and compression strains of section of the BHA. The DDSRs measure acceleration and gravitational field along the BHA. The BHA may also include gyroscopic sensors such as evaders to measure angular rotational rate, rotary sensors to measure point direction angle and bending angle in the BHA, magnetometer sensors to measure magnetic field, and pressure sensors to measure depth.

At 604, the drilling is paused to determine a survey position of the bit. During pauses in drilling, which are usually thirty feet apart due to new sections of pipe being added to the top of the drillstring, surveys may be performed. Such surveys may provide the bit position as a fix in a dead-reckoning algorithm. The surveys cannot be performed during drilling due to interference caused by the powerful forces necessary to rotate the bit.

At 606, drilling is resumed and measurements are obtained with BHA sensors while drilling. At this point, a dead-reckoning model may be trained using the BHA sensor measurements and one or more surveys as training data. Specifically, the dead-reckoning algorithm is performed on the training data, and the difference between calculated bit positions and known bit positions, or error, is fed back into the model for tuning purposes. Additionally, a noise model may be created to account for noise received during sensor measurements.

At 608, the BHA sensor measurements are processed with a dead-reckoning model while drilling to track a current position of the bit relative to the survey position. By modeling the entire BHA as a deformable body, accurate positioning data may be calculated. Specifically, the dead-reckoning model accounts for deformation of the BHA by modeling the BHA as a plurality of sections, each beginning at a local origin and ending at a point within a local coordinate system. A plurality of coordinate transformations may be performed, using kinematic or dynamic modeling of the BHA, to ascertain the global coordinates, or position, of the bit. The model fully characterizes the kinematics of the BHA while accounting for deformation, and the model may also determine a bit velocity vector during drilling. In at least one embodiment, processing the measurements may include filtering the measurements using a Kalman filtering framework to provide statistically optimal position and/or attitude determination.

At 610, if a deviation greater than a threshold, which may be adjustable, is detected between the current position of the bit and the desired trajectory of the bit, a new survey may be triggered at 604. For example, drilling may be paused, and a new survey may be performed. In an alternative embodiment, a new survey may be performed during the next scheduled pause in drilling. At 612, if a deviation has not been detected, the BHA is steered based on the current position of the bit. Such steering may occur automatically, i.e., without human input.

A method of continuous location while drilling includes drilling a borehole with a bottom-hole assembly (BHA) terminated by a drill bit; pausing the drilling to determine a survey position of the bit; obtaining measurements with BHA sensors while drilling; processing the BHA sensor measurements with a dead-reckoning model while drilling to track a current position of the bit relative to the survey position, the dead-reckoning model accounting for deformation of the BHA; and steering the BHA based on the current position of the bit.

The method may include training the dead-reckoning model to use the BHA sensor measurements for dead reckoning current positions of the bit. The model may model the BHA as a plurality of rigid bodies and calculates a set of local coordinates for each rigid body in the plurality. The model may determine a bit velocity vector during drilling. The method may include determining a tool arrangement that enables the BHA sensors to fully characterize kinematics of the BHA while accounting for BHA deformation. The BHA sensors may include strain sensors, accelerometers, and gyrometers. The method may include detecting a deviation, while drilling, between the current position of the bit and a desired position of the bit; and triggering, based on the deviation, a survey to be performed during the next pause in drilling A locating while drilling system includes a bottom-hole assembly (BHA), terminated by a drill bit, comprising BHA sensors; and a processing unit that collects measurement while drilling (MWD) measurements from the BHA sensors and uses the measurements in a dead-reckoning model to track a current position of the bit relative to a survey position, the dead-reckoning model accounting for deformation of the BHA.

The processing unit may cause the current position to be displayed. The processing unit may be downhole. The BHA may include a steering mechanism that compares the current position to a desired position. The processing unit may train the dead-reckoning model to use the MWD measurements for dead reckoning current positions of the bit. The model may model the BHA as a plurality of rigid bodies and calculates a set of local coordinates for each rigid body in the plurality. The model may determine a bit velocity vector during drilling. The BHA may be assembled with a tool arrangement that enables the BHA sensors to fully characterize kinematics of the BHA while accounting for BHA deformation. The BHA sensors may include strain sensors, accelerometers, and gyrometers. The processing unit may detect a deviation, while drilling, between the current position of the bit and a desired position of the bit, and trigger, based on the deviation, a survey to be performed during the next pause in drilling.

While the present disclosure has been described with respect to a limited number of embodiments, those skilled in the art will appreciate numerous modifications and variations therefrom. It is intended that the appended claims cover all such modifications and variations.

What is claimed is:

1. A method of continuous location while drilling that comprises:

drilling a borehole with a bottom-hole assembly (BHA) attached to a drill bit;

determining a survey position of the bit;

obtaining measurements with BHA sensors while the drill bit is turning;

processing the BHA sensor measurements with a model while drilling to track a current position of the bit relative to the survey position, the model accounting for deformation of the BHA; and training the model to use the BHA sensor measurements for dead-reckoning current positions of the bit.

2. The method of claim 1, wherein the model models the BHA as a plurality of rigid bodies and calculates a set of local coordinates for each rigid body in the plurality.

3. The method of claim 1, wherein the model determines a bit status vector during drilling.

4. The method of claim 1, further comprising determining a tool arrangement that enables the BHA sensors to fully characterize kinematics of the BHA while accounting for BHA deformation.

5. The method of claim 1, wherein the BHA sensors include strain sensors, accelerometers, magnetometers, and gyroscopes.

6. The method of claim 1, further comprising:

detecting a deviation, while drilling, between the current position of the bit and a desired position of the bit; and triggering, based on the deviation, a survey to be performed during the next pause in drilling.

7. A locating while drilling system that comprises:

a BHA, attached to a drill bit, comprising BHA sensors; and a processing unit configured to:

receive measurement while drilling (MWD) measurements from the BHA sensors;

employ the measurements in a model to track a current position of the bit relative to a survey position, the model accounting for deformation of the BHA; and train the model to use the MWD measurements for dead reckoning current positions of the bit.

8. The system of claim 7, wherein processing unit causes the current position to be displayed.

9. The system of claim 7, wherein the processing unit is downhole.

10. The system of claim 7, wherein the BHA includes a steering mechanism that compares the current position to a desired position.

11. The system of claim 7, wherein the model models the BHA as a plurality of rigid bodies and calculates a set of local coordinates for each rigid body in the plurality.

12. The system of claim 7, wherein the model determines a bit velocity vector during drilling.

13. The system of claim 7, wherein the BHA is assembled with a tool arrangement that enables the BHA sensors to fully characterize kinematics of the BHA while accounting for BHA deformation.

14. The system of claim 7, wherein the BHA sensors include strain sensors, accelerometers, magnetometers, and gyroscopes.

15. The system of claim 7, wherein the processing unit detects a deviation, while drilling, between the current position of the bit and a desired position of the bit, and triggers, based on the deviation, a survey to be performed during the next pause in drilling.

16. A method of continuous location while drilling that comprises:

obtaining measurements with BHA sensors while a drill bit is turning;

processing the BHA sensor measurements with a model while drilling to track a current position of the bit relative to a survey position, the model accounting for deformation of the BHA;

steering the BHA automatically based on the current position of the bit; and training the model to use the BHA sensor measurements for dead-reckoning current positions of the bit.

17. The method of claim 16, wherein the model models the BHA as a plurality of rigid bodies and calculates a set of local coordinates for each rigid body in the plurality.

* * * * *